US011319950B2

(12) United States Patent
Vezzosi

(10) Patent No.: US 11,319,950 B2
(45) Date of Patent: May 3, 2022

(54) PISTON PUMP WITH SIMPLIFIED HEAD

(71) Applicant: COMET S.P.A., Reggio Emilia (IT)

(72) Inventor: Enrico Vezzosi, Reggio Emilia (IT)

(73) Assignee: COMET S.P.A., Reggio Emilia (IT)

( * ) Notice: Subject to any disclaimer, the term of this patent is extended or adjusted under 35 U.S.C. 154(b) by 706 days.

(21) Appl. No.: 16/258,177

(22) Filed: Jan. 25, 2019

(65) Prior Publication Data

US 2019/0264681 A1 Aug. 29, 2019

(30) Foreign Application Priority Data

Feb. 23, 2018 (IT) ..... 102018000002995

(51) Int. Cl.

| | |
|---|---|
| ***F04B 53/10*** | (2006.01) |
| ***F04B 53/16*** | (2006.01) |
| ***F04B 53/00*** | (2006.01) |
| ***F04B 1/0452*** | (2020.01) |

(52) U.S. Cl.

CPC ..... *F04B 53/1025* (2013.01); *F04B 1/0452* (2013.01); *F04B 53/007* (2013.01); *F04B 53/10* (2013.01); *F04B 53/16* (2013.01)

(58) Field of Classification Search

CPC ..... F04B 1/0452; F04B 53/007; F04B 53/10; F04B 53/16; F04B 53/1025; F04B 53/109

USPC ..... 417/454

See application file for complete search history.

(56) References Cited

U.S. PATENT DOCUMENTS 578,002 A * 3/1897 Clark ..... F04B 53/109 417/567
2,330,781 A * 9/1943 Langmyhr ..... F04B 5/00 417/432
3,330,217 A * 7/1967 Johnw ..... F04B 5/00 417/454
4,618,316 A 10/1986 Elliott (Continued)

FOREIGN PATENT DOCUMENTS

EP 0908627 A2 4/1999
EP 1450045 A1 8/2004

*Primary Examiner* — Dominick L Plakkoottam
*Assistant Examiner* — Charles W Nichols
(74) *Attorney, Agent, or Firm* — Pearne & Gordon LLP

(57) ABSTRACT

A piston pump, comprising:

a main body (2);

a head (3), sealingly associated with the main body (2) at a coupling surface (3*a*);

a pumping chamber (4), at least one portion of which is afforded in the head (3);

a piston (5), provided with a head (5*a*) that is sealingly slidable in the pumping chamber (4) along a longitudinal direction (X);

a valve seat (6), afforded in the head (3), which has an access opening (6*a*) on the coupling surface (3*a*) and is placed in communication with an intake manifold (S), with a delivery manifold (D) and with the pumping chamber (4);

a suction valve (7) and a delivery valve (8) arranged sealingly inside the valve seat (6);

wherein the suction valve (7) is movable between an opening position, in which it enables communication between the intake manifold (S) and the pumping chamber (4), and a closing position, in which it prevents communication between the intake manifold (S) and the pumping chamber (4);

and wherein the delivery valve (8) is movable between an opening position, in which it enables communication (Continued)

between the intake manifold (D) and the pumping chamber (4), and a closing position, in which it prevents communication between the delivery manifold (D) and the pumping chamber (4).

8 Claims, 2 Drawing Sheets

(56) References Cited

U.S. PATENT DOCUMENTS

| | | | | |
|---|---|---|---|---|
| 4,661,050 | A * | 4/1987 | Deminski | F04B 39/10 417/454 |
| 5,171,136 | A | 12/1992 | Pacht | |
| 6,019,125 | A | 2/2000 | Reverberi | |
| 6,508,637 | B2 * | 1/2003 | Ohashi | F04B 39/102 417/312 |
| 8,408,886 | B2 | 4/2013 | Fabbri | |
| 2004/0161353 | A1 | 8/2004 | Fabbri | |

* cited by examiner

PISTON PUMP WITH SIMPLIFIED HEAD

The present invention relates to a piston pump.

The invention relates in particular to a pump equipped with one or more pistons activated in alternated sliding by a crank shaft, to which they are connected through respective rods.

The end of each piston is movable inside a pumping chamber that is placed in communication with a suction conduit and with a delivery conduit. Between the pumping chamber and the suction and delivery conduits a suction valve and a delivery valve are interposed, respectively. The suction valve allows the passage of fluid from the suction conduit to the pumping chamber, while preventing the inverse passage. The delivery valve instead allows the passage of fluid from the pumping chamber to the delivery conduit, while preventing the inverse passage.

In currently available pumps, the suction and delivery valves are oriented perpendicular to each other. In substance, each valve is arranged inside its own cylindrical seat, afforded in the pump head. The two seats are oriented with their longitudinal axes parallel to each other, in order to contain the dimensions of the pump head.

For construction reasons, each valve must be introduced into its own seat from the outside of the head. For that purpose, each seat leads onto the outer surface of the head. Following the introduction of the related valve, the seat can be closed with a screw cap again, which also holds the valve in position.

The creation of valve seats that lead onto the surface of the head, the creation of the threads of the end of the seats to allow the application of the cap, and the provision of a cap for each seat, require significant processing times and costs. Also the mounting of the pump is affected by the need to apply a screw cap for each valve. Furthermore, the cap of the suction valve seat is subject to a pulsating load due to the pressure variation from the suction valve to the delivery valve with consequent fatigue phenomena that lead to the loosening of the caps and to wear on the cap seals.

The aim of the present invention is to solve the drawbacks of the currently available pumps.

An advantage of the pump according to the present invention is that it does not require valve seats that open onto the head surface.

Another advantage is that of not requiring caps for closing the valve seats.

Further characteristics and advantages of the present invention will become more apparent in the following detailed description of an embodiment of the present invention, illustrated by way of non-limiting example in the attached figures, wherein.

Figure 1:
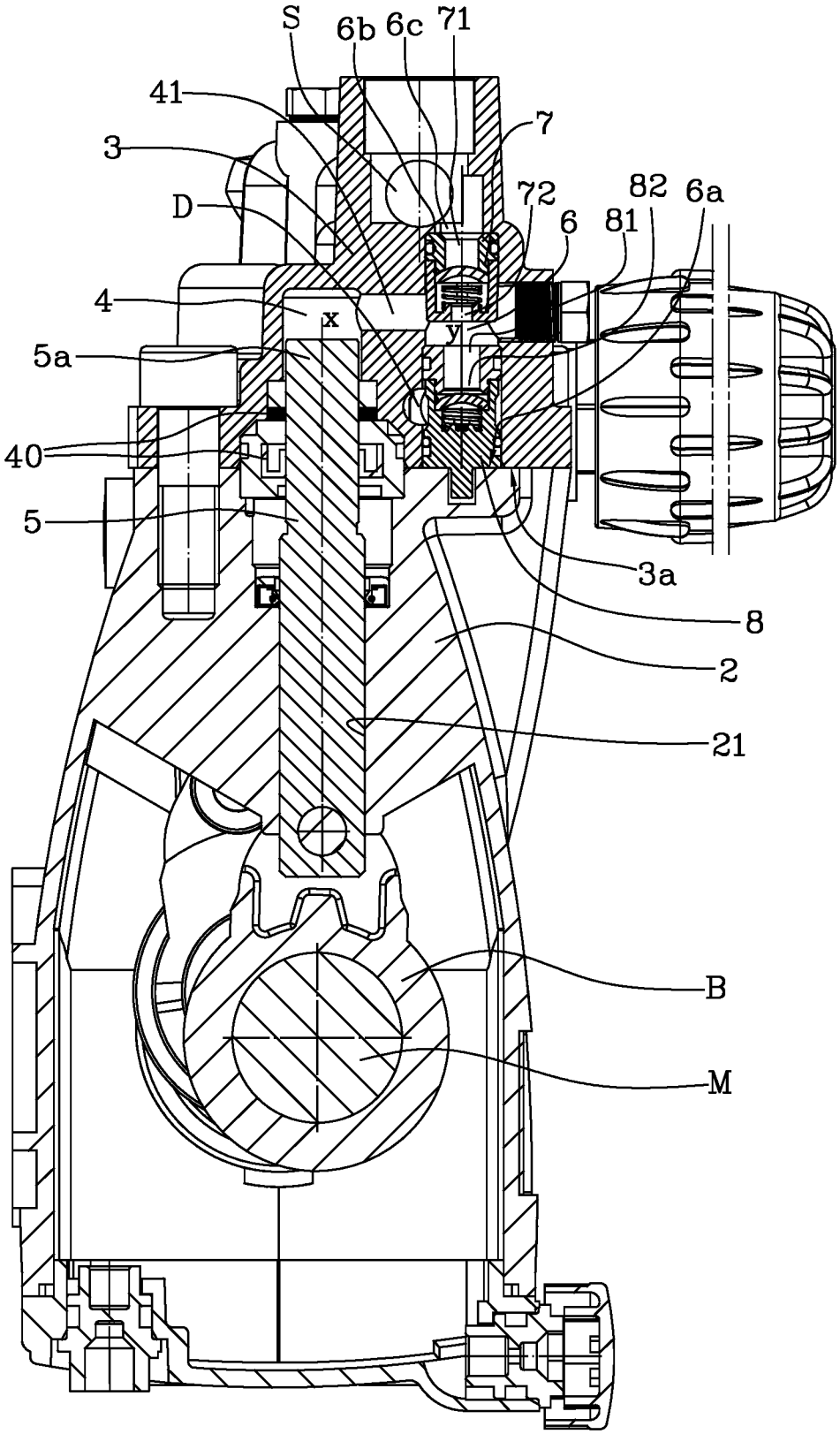
FIG. 1 is a sectional view of a pump according to the present invention.
Figure 2:
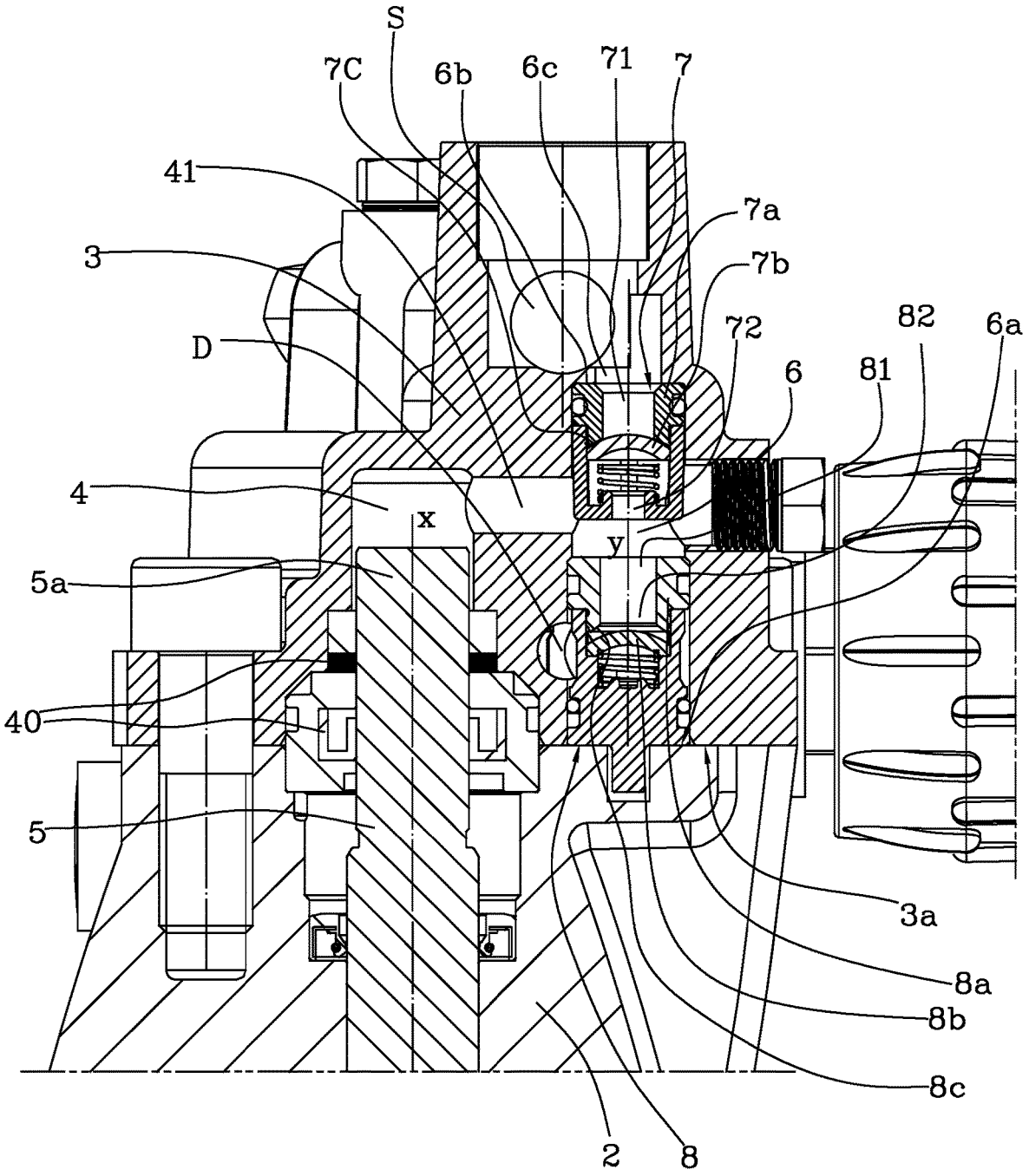
FIG. 2 is an enlargement of the head zone (3) of the pump of FIG. 1.

The piston pump according to the present invention comprises a main body (2), inside which one or more pistons (5) are arranged. The main body (2) further comprises the drive shaft (M) of the pump and the connecting rods (B) between the drive shaft (M) and the pistons (5). The following description relates to a single piston (5) that can be seen in the section illustrated in FIG. 1, but it is valid for every piston with which the pump is equipped.

Each piston (5) is slidable along a longitudinal direction (X) in a cylindrical seat (21), arranged inside the main body (2). Each piston is provided with a head (5*a*), that projects outside the main body (2) and the cylindrical seat (21).

The pump further comprises a head (3), sealingly associated with the main body (2) at a coupling surface (3*a*). A pumping chamber (4) is afforded in the head (3). The head (5*a*) of the piston (5) is sealingly slidable in the pumping chamber (4) along the longitudinal direction (X).

In the embodiment shown, the pumping chamber (4) is in the form of a blind compartment that opens at the coupling surface (3*a*) and is aligned with the seat (21) of the main body (2) along the longitudinal direction (X). The pumping chamber (4) is provided with annular seals (40) inside which the head (5*a*) of the piston (5) is slidable.

The pump according to the present invention comprises a valve seat (6), afforded in the head (3), which has an access opening (6*a*) on the coupling surface (3*a*) and is placed in communication with an intake manifold (S), with a delivery manifold (D) and with the pumping chamber (4). In substance, the valve seat (6) is accessible through the access opening (6*a*), and is closed by the main body (2) when the latter is sealingly coupled to the head (3), at the coupling surface (3*a*). The valve seat (6) does not have any further access openings, as the single access opening (6*a*), arranged on the coupling surface (3*a*) of the head is sufficient for the introduction of the suction and delivery valves (7,8).

A suction valve (7) and a delivery valve (8) are arranged sealingly inside the valve seat (6). In other words, both the suction valve (7) and the delivery valve (8), necessary for the correct operation of the piston (5), are located inside a same valve seat (6).

Advantageously, with the head (3) uncoupled from the body (2), the two valves (7,8) can be inserted into the valve seat (6) through the access opening (6*a*). In particular, the valve seat (6) has a bottom (6*b*) in contact with which a first valve (7) can be arranged. The second valve (8) can be inserted in the valve seat (6) after the first valve (7). In the embodiment shown, the suction valve (7) is inserted first into the valve seat (6), placed in contact with the bottom (6*b*). The delivery valve (8) is inserted after the suction valve (7). Once both valves (7,8) have been inserted, the head (3) can be coupled to the body (2), closing the valve seat (6) again. In an alternative solution, the access opening (6*a*) of the valve seat (6) can be closed through a threaded cap or a plate prior to the coupling of the head (3) to the body (2).

The notable simplification that the pump according to the invention achieves, both in relation to the mounting/dismounting of the suction and delivery valves (7,8) and in relation to the creation of the valve seat (6) is therefore clear. With regard to the first aspect, the pump according to the present invention does not require the use of caps for closing the seats of the suction and delivery valves (7,8). All the time taken for the application or removal of such caps, present in currently available pumps, is in fact no longer necessary. Furthermore, the creation of the valve seat (6) can be obtained by substantially making a hole in the head (3) on the coupling surface (3*a*). Furthermore, it is not necessary to create any thread for the application of a closing cap, as the valve seat (6) is closed through coupling with the main body (2). The problem of the pulsating tension on the screwed cap and the consequent fatigue phenomena that lead to the loosening of the caps and wear on the cap seals is also eliminated. The valve seat (6) is substantially shaped like a blind hole, which opens onto the coupling surface (3*a*), except for the further communication passages that place the valve seat (6) in connection with the intake manifold (S), with the delivery manifold (D) and with the pumping chamber (4).

In the embodiment shown, the valve seat (6) has a longitudinal axis (Y). Preferably, but not necessarily, longitudinal axis (Y) is parallel to the longitudinal sliding direction (X) of the piston (5). This allows the valve seat (6) to be moved nearer to the pumping chamber (4), so that it is possible to reduce the dimensions of the head (3).

The suction valve (7) and the delivery valve (8) are inserted in the valve seat (6) concentrically to the longitudinal axis (Y). The suction valve (7) has an inlet opening (71), placed in communication with the intake manifold (S), and an outlet opening (72), placed in communication with the pumping chamber (4). The delivery valve (8), in turn, has an inlet opening (81), placed in communication with the pumping chamber (4), and an outlet opening (82), placed in communication with the delivery manifold (D). The outlet opening (72) of the suction valve (7) faces the inlet opening (81) of the delivery valve (8).

The suction valve (7) is movable between an opening position, in which it enables communication between the intake manifold (S) and the pumping chamber (4), and a closing position, in which it prevents communication between the intake manifold (S) and the pumping chamber (4). In turn, the delivery valve (8) is movable between an opening position, in which it enables communication between the delivery manifold (D) and the pumping chamber (4), and a closing position, in which it prevents communication between the delivery manifold (D) and the pumping chamber (4).

For that purpose, each valve (7,8) is provided with its own shutter, pushed towards the closing position by an elastic means, e.g. a spring.

In the embodiment shown, each valve (7,8) comprises a body (7*a*,8*a*), provided with gaskets for being sealingly inserted in the valve seat (6). The suction valve (7) comprises a shutter (7*b*) movable along the longitudinal axis (Y) between the opening position, in which it is distanced from a sealing seat (7*c*), and the closing position, in which it is in contact with the sealing seat (7*c*). A spring pushes the shutter (7*b*) towards the closing position.

Likewise, the delivery valve (8) comprises a shutter (8*b*) movable along the longitudinal axis (Y) between the opening position, in which it is distanced from a sealing seat (8*c*), and the closing position, in which it is in contact with the sealing seat (8*c*). A spring pushes the shutter (8*b*) towards the closing position.

The suction and delivery valves (7,8) are arranged so that the thrust exerted by the elastic means or springs is concordant, i.e. in the same direction. In this way, during the suction stroke of the piston (5), i.e. during the stroke that increases the volume of the pumping chamber (4), the suction valve (7) is brought into the opening position, while the delivery valve (8) is brought into the closing position. In fact, the depression produced in the pumping chamber produces a thrust on the shutter of the suction valve (7) which brings it into the opening position. The same depression keeps the shutter of the delivery valve (8) in the closing position.

During the delivery stroke of the piston (5), i.e. during the stroke that reduces the volume of the pumping chamber (4), the suction valve is brought into the closing position, while the delivery valve is brought into the opening position. In fact, the depression produced in the pumping chamber produces a thrust on the shutter of the suction valve (7) concordant with the thrust exerted by the elastic means, which brings it into the closing position. The same pressure pushes the shutter of the delivery valve (8) into the opening position, in contrast with the action of the elastic means.

The pumping chamber (4) is placed in communication with the valve seat (6) via a connecting conduit (41), afforded in the head (3) along a perpendicular direction to the longitudinal direction (X).

The conformation and arrangement of the valve seat (6) allows the delivery manifold (D) to be afforded in the head (3), in a space comprised between the piston (5) and the valve seat (6). This allows the dimensions of the head (3) to be reduced. In particular, the delivery manifold (D) can be arranged alongside the valve seat (6), in communication with the outlet opening (82) of the delivery valve (8).

The conformation and arrangement of the valve seat (6) also allows the intake manifold (S) to be afforded in the head (3), in a proximal position to the valve seat (6). In the embodiment shown, the intake manifold (D) can be arranged in proximity to the valve seat (6), in communication with the inlet opening (71) of the suction valve through a passage (6*c*).

The invention claimed is:

1. A piston pump, comprising:

a main body (2);

a head (3), sealingly associated to the main body (2) at a coupling surface (3*a*);

a pumping chamber (4), at least one portion of which is afforded in the head (3);

a piston (5), provided with a head (5*a*) that is sealingly slidable in the pumping chamber (4) along a longitudinal direction (X);

characterised in that it comprises:

a valve seat (6), afforded in the head (3), which has an access opening (6*a*) on the coupling surface (3*a*) and is placed in communication with an intake manifold (S), with a delivery manifold (D) and with the pumping chamber (4);

a suction valve (7) and a delivery valve (8) sealingly arranged internally of the valve seat (6) wherein a suction valve portion of the valve seat (6) is sized smaller than a delivery valve portion of the valve seat (6), so the delivery valve (8) can be inserted after the suction valve (7);

wherein the suction valve (7) is movable between an opening position, in which it enables communication between the intake manifold (S) and the pumping chamber (4), and a closing position, in which it prevents communication between the intake manifold (S) and the pumping chamber (4); and wherein the delivery valve (8) is movable between an opening position, in which it enables communication between the delivery manifold (D) and the pumping chamber (4), and a closing position, in which it prevents communication between the delivery manifold (D) and the pumping chamber (4), wherein the delivery manifold (D) is afforded in the head (3), in a space comprised between the piston (5) and the valve seat (6).

2. The pump according to claim 1, wherein the valve seat (6) has a longitudinal axis (Y), and wherein the suction valve (7) and the delivery valve (8) are inserted in the valve seat (6) concentrically with the longitudinal axis (Y).

3. The pump according to claim 2, wherein:

the suction valve (7) has an inlet opening (71), placed in communication with the intake manifold (S), and an outlet opening (72), placed in communication with the pumping chamber (4);

the delivery valve (8) has an inlet opening (81), placed in communication with the pumping chamber (4), and an outlet opening (82), placed in communication with the delivery manifold (D);

the outlet opening (72) of the suction valve (7) faces the inlet opening (81) of the delivery valve (8).

4. The pump according to claim 1, wherein the valve seat (6) has a longitudinal axis (Y) that is parallel to the longitudinal sliding direction (X) of the piston (5).

5. The pump according to claim 4, wherein the pumping chamber (4) is placed in communication with the valve seat (6) via a connecting conduit (41), afforded in the head (3) along a direction perpendicular to the longitudinal direction (X).

6. The pump according to claim 1, wherein the intake manifold (S) is afforded in the head (3), in a position in proximity of the valve seat (6).

7. The pump according to claim 1, wherein the access opening (6*a*) of the valve seat (6) is closed by a screwed cap or by a plate.

8. The pump according to claim 1, wherein the suction valve (7) and the delivery valve (8) are spaced apart from the abutment surface.

* * * * *